US005214022A

United States Patent [19]

Busch et al.

[11] Patent Number: 5,214,022

[45] Date of Patent: May 25, 1993

[54] METHOD FOR TRANSFER PRINTING AN IMAGE MOTIF ONTO A DECOR FILM

[75] Inventors: Juergen Busch, Uetersen; Dieter Endruhn, Appel/Eversen-Heide, both of Fed. Rep. of Germany

[73] Assignee: Deutsche Airbus GmbH, Bremen, Fed. Rep. of Germany

[21] Appl. No.: 665,700

[22] Filed: Mar. 6, 1991

[30] Foreign Application Priority Data

Mar. 8, 1990 [DE] Fed. Rep. of Germany ..... 4007369

[51] Int. Cl.[5] ..... B41M 5/035; B41M 5/38

[52] U.S. Cl. ..... 503/227; 428/141; 428/195; 428/913; 428/914

[58] Field of Search ..... 8/471; 428/195, 913, 428/914, 141; 503/227

[56] References Cited

U.S. PATENT DOCUMENTS 4,923,848 5/1990 Akada et al. ..... 503/227

FOREIGN PATENT DOCUMENTS

0110220A2 6/1984 European Pat. Off. ..... 503/227

2731121 1/1979 Fed. Rep. of Germany ..... 503/227

*Primary Examiner*—B. Hamilton Hess

*Attorney, Agent, or Firm*—W. G. Fasse

[57] ABSTRACT

An image motif is transfer printed onto a decor film made of an organic material having a texture surface with ridges and valleys. A stack is formed on a supporting surface by placing the decor film, a motif carrier, and a pressure transfer mat, in that order, on the supporting surface. The motif carrier and the pressure transfer mat are sufficiently flexibly yielding for intimately contacting all surfaces of the decor film when heat and pressure are applied to the stack. The pressure is applied through the pressure transfer mat or in a heatable press.

7 Claims, 1 Drawing Sheet

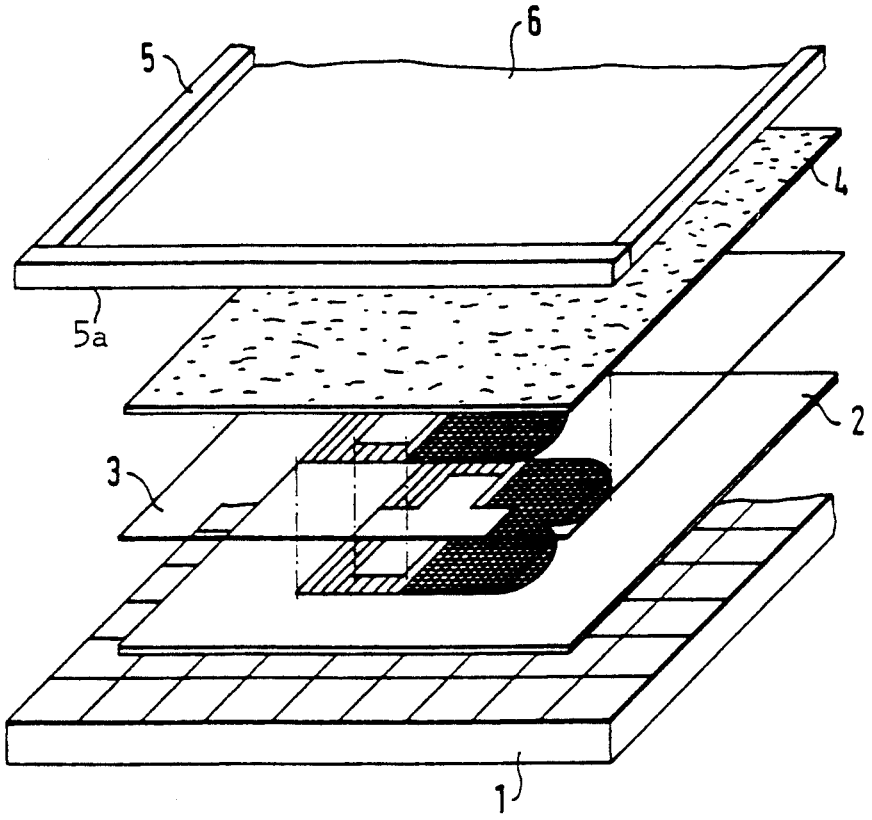
6
5
4
5a
2
3
1

METHOD FOR TRANSFER PRINTING AN IMAGE MOTIF ONTO A DECOR FILM

FIELD OF THE INVENTION

The invention relates to a method for transfer printing an image motif onto a decor film made of an organic material, such as polyvinylfluoride, especially for decorating interior surfaces in an aircraft cabin.

BACKGROUND INFORMATION

Transfer printing processes are known in the art, whereby a decor film is brought into intimate contact with a motif carrier for the transfer of the motif image onto the decor film. The motif carrier carries or contains the motif image in the form of organic dispersive dyes. The pressure needed for the transfer is applied through a structured mat, whereby pressure and heat are supplied simultaneously for the transfer of the motif by diffusion of the dyes onto the decor film.

The application of the above method has encountered problems when the decor film on which the image motif is to be printed, has a structured surface. By "structured surface" is meant a textured surface having ridges and valleys which is the case, for example, for imitation leather-type surfaces or grained surfaces. Materials with such surfaces are used for decorating purposes on the interior structural components of aircraft cabins to form flat and curved surface components. Such covering materials are produced as films having a layered structure with a cover layer made, for example, of a polyvinyl fluoride. Lightweight composite panels made of fiber reinforced synthetic materials are used for this purpose and covered with the above mentioned films. Depending on the final application,the panels may have a plane or curved configuration.

For decorative purposes the films also referred to as decor films, having the above mentioned structured surface, can be printed with images by screen printing processes. Due to the limitations inherent in such screen printing processes it is basically possible only to produce single or multi-color line motifs. An application of, for example, photographically recorded images or motifs on the respective films is not possible by screen printing processes. However, it is known to transfer such photographically recorded image motifs by means of the transfer printing process. This process, however, has been limited heretofore to smooth surfaces, for example, acrylic glass plates.

European Patent Publication (EP) 0,110,220 A2 shows a respective method for transfer printing on solid objects of synthetic material or on objects covered with a surface coating of lacquer or synthetic material. The transfer printing uses a surface area dye carrier, whereby the dye transfer takes place at a suitable temperature while pressing the dye carrier onto the surface of the object to be printed. The printing pressure on the surface area dye carrier is accomplished by a gas pressure in excess of the atmospheric pressure, and the surface to be printed is kept at a temperature below the thermoplastic range of the material to be printed. This known method of transfer printing makes sure that the originally glossy surface of an object to be printed is retained even after the printing. This retaining of the glossy surface is enhanced by utilizing the characteristic of certain types of acrylic glass. This characteristic is the ability to assume a thermo-elastic state without entering into a thermoplastic state. Additionally, certain measures are taken in order to contact the dye or motif carrier with the object to be printed only for a short duration. The just mentioned European Publication also teaches the use of a felt cloth in those instances where it is intended to obtain a mat finish as a result of the printing on the initially glossy printed surface. The felt cloth thus embosses the printed surface which was originally smooth and glossy to obtain a mat surface.

German Patent Publication (DE-OS) 2,731,121 illustrates a method for producing prints on surfaces of formed bodies of thermoplastic synthetic materials by means of dispersion dyes without any bonding agents. In this known method the dyes are first applied to an intermediate carrier by means of conventional printing techniques. The so-prepared intermediate carrier is then pressed onto the surface to be printed while simultaneously heating the surface of the formed body to a temperature sufficient for a sublimation and diffusion of the dyes. This known method makes it possible to print on formed bodies of thermoplastic synthetic materials, for example liquid containers, without destroying the shape of these formed bodies due to the temperatures that are necessary for performing the known transfer printing.

It is also known to transfer a photographic image onto a film of, for example, polycarbonate by a diffusion transfer and to then adhesively bond such film onto a surface such as a panel, for example, a door panel. This known method, however, is not suitable for transferring a photographic image motif onto a synthetic material film which has already a structured, textured surface rather than a smooth surface.

OBJECTS OF THE INVENTION

In view of the above it is the aim of the invention to achieve the following objects singly or in combination:

to provide a transfer printing method capable of transferring a photographic image onto a synthetic material film which has a rough surface textured with ridges and valleys;

to permit the application or transfer printing of such images onto three-dimensionally shaped surfaces such as interior wall sections of an aircraft cabin or the like; and to provide a method for transfer printing line motifs as well as photographic motifs onto rough surfaces that were difficult to print heretofore.

SUMMARY OF THE INVENTION

The above objects have been achieved according to the invention by providing a structured surface decor film having ridges and valleys and transfer printing from a motif carrier, whereby the dye transfer takes place at a temperature at which substantially no plastifying occurs in the structured surface of the decor film and by using a structured pressure transfer mat which is made of such a flexibly yielding material that the motif carrier is forced into an intimate contact with the decor film in response to applied pressure so that the motif carrier even contacts all the structural valleys in the surface of the decor film and the printing dyes are transferred even into the valleys.

It is a special advantage of the invention that it is capable of transfer printing not only photographically recorded motifs, but also any of the motifs that were heretofore applied by screen printing techniques and that all these motifs can be applied to structural components with a rough surface at reduced costs, since the motif carriers can be formed on paper by rotation printing techniques which is less expensive and more efficient than screen printing techniques.

BRIEF DESCRIPTION OF THE DRAWING

In order that the invention may be clearly understood, it will now be described, by way of example, with reference to the single figure of the accompanying drawing which shows an exploded view of the stack formation for the present transfer printing operation.

DETAILED DESCRIPTION OF PREFERRED EXAMPLE EMBODIMENTS AND OF THE BEST MODE OF THE INVENTION

The invention is practiced on a work surface 1 onto which the so-called decor film 2 having said rough surface textured with ridges and valleys to be printed, is first placed as the first member of a stack with the rough surface facing up. A motif carrier 3 is then placed smoothly onto the rough surface of the decor film 2. Next, a structured flexible pressure transfer mat 4 is placed on the motif carrier 3. The structured flexible mat 4 is in turn covered by a vacuum-tight cloth 6 that is held in a stretcher frame 5. The frame 5 is provided with a gasket 5*a* all around that will provide a vacuum-tight seal when the frame is placed onto the work surface 1 so that the space in which the stack is enclosed, can be evacuated by a conventional vacuum pump not shown. The enclosed space is then evacuated to establish a reduced pressure of about 0.9 bar, whereby the vacuum-tight cloth 6 is tightly pressed against the flexible pressure transfer mat 4 which in turn presses the motif carrier 3 tightly against the structured rough surface of the decor film 2 facing the motif carrier 3.

The material of the pressure transfer structured mat 4 is such that it can flexibly yield to the pressure exerted by the cloth 6 thereby causing the motif carrier 3 which is also sufficiently flexible, to intimately contact said ridges and enter into said valleys so that all areas, of said rough surface including the valleys of the surface of the flexible decor film 2 are in a motif transferring contact with the motif carrier 3.

Once this state has been achieved by the application of pressure the stack is heated to a suitable temperature which is less than the plastifying temperature of the decor film 2, but sufficient to cause a diffusion dye transfer, whereby said rough surface retains its texture while said motif is being transferred. This temperature is, for example, 130° C. when the decor film 2 is made of polyvinylfluoride. The pressure and temperature is maintained for about 5 minutes, whereafter the transfer printing is completed and the decor film 2 now carrying the motif, such as a photograph, can be taken out of the stack after cooling and venting of the vacuum cloth 6. In this way the decor film 2 retains its rough surface.

It has been found that with this method using a flexibly yielding structured pressure transfer mat 4 it is assured that the decor film 2 is printed without faults even in the structural valleys on the surface of the film 2. This new effect is caused by the vacuum cloth 6 in combination with the pressure transfer mat 4. However, a heatable press not using a vacuum cloth may also be used for applying the required heat and pressure to the stack provided the motif carrier 3 and mat 4 are sufficiently flexible.

The motif on the motif carrier 3 comprises the conventional transfer dyes based on organic dispersion dye molecules. Materials suitable for the decor film are, for example, all organic materials such as polycarbonate, polyamide, polyurethane, polyether-etherketone, polyetherimide, or polyvinylfluoride. In case the decor film 2 has a layered structure it is sufficient that the top layer to be printed is made of one of the just listed synthetic materials.

The structured mat 4 for the pressure transfer is preferably a so-called needled felt, for example, known in the trade under the tradename RC3000, needled felt manufactured by: Richmond, LA, a company of the United States.

As mentioned, the temperatures will depend on the types of materials used, especially for the decor film 2 and the mentioned 130° C. are suitable for a diffusion color or dye transfer onto a decor film 2 made of polyvinyl fluoride.

Panels may also be printed in accordance with the present teaching provided that at least the surface layer of the panel is made of one of the above mentioned synthetic materials.

Further, the pressure transfer structured mat 4 may be made of a rubber elastomeric material, such as a silicone elastomer. The silicone elastomer mat is especially suitable for use in a heatable press, whereby shorter time durations are achieved for each work cycle.

Although the invention has been described with reference to specific example embodiments it will be appreciated that it is intended to cover all modifications and equivalents within the scope of the appended claims.

What we claim is:

1. A method for transfer printing an image onto a decor film having a rough surface, comprising the following steps:

(a) placing said decor film of an organic material having a rough surface textured with ridges and valleys, onto a supporting surface with said ridges and valleys facing up;

(b) placing a flexible motif carrier sheet carrying said image in the form of organic, dispersive dyes, onto said ridges and valleys of said decor film;

(c) placing a pressure transfer mat of a flexibly yielding material onto said motif carrier, (d) applying a transfer printing pressure to said stack through said flexibly yielding pressure transfer mat so that said motif carrier sheet is pressed intimately into a motif transfer contact with all surface areas of said rough surface of said decor film including said valleys and ridges for transfer printing said image onto said rough surface of said decor film by diffusion of said dispersive dyes onto said ridges and into said valleys, and (e) heating said stack to a temperature just below a plastifying temperature of said decor film to avoid plastifying said rough surface of said decor film under said printing pressure while said image is being transferred from said motif carrier to said rough surface of said decor film.

2. The method of claim 1, further comprising enclosing said stack with a vacuum-tight flexible cloth, and applying said transfer printing pressure by evacuating a space enclosed by said flexible cloth.

3. The method of claim 1, further comprising using a needled felt material as said flexibly yielding material for said transfer mat.

4. The method of claim 1, further comprising using rubber elastic material as said flexibly yielding material for said transfer mat.

5. The method of claim 4, wherein said rubber elastic material is silicone rubber.

6. The method of claim 1, wherein said transfer printing pressure is applied in a heatable press.

7. The method of claim 1, wherein said decor film is polyvinylfluoride, wherein said heating temperature is about 130° C., and wherein said pressure and temperature are maintained for about 5 minutes.

* * * * *